US007207315B2

(12) United States Patent
Maruyama

(10) Patent No.: US 7,207,315 B2
(45) Date of Patent: Apr. 24, 2007

(54) DEVICE AND METHOD FOR CONTROLLING INTERNAL COMBUSTION ENGINE

(75) Inventor: Kenya Maruyama, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 19 days.

(21) Appl. No.: 11/166,269

(22) Filed: Jun. 27, 2005

(65) Prior Publication Data

US 2006/0021594 A1 Feb. 2, 2006

(30) Foreign Application Priority Data

Aug. 2, 2004 (JP) ..... 2004-226035

(51) Int. Cl.
*F02B 7/00* (2006.01)
*F02B 7/04* (2006.01)

(52) U.S. Cl. ..... 123/431; 123/299

(58) Field of Classification Search ..... 123/431, 123/299, 300, 305, 681
See application file for complete search history.

(56) References Cited

U.S. PATENT DOCUMENTS 5,357,925 A 10/1994 Sasaki
2005/0172931 A1* 8/2005 Mori ..... 123/305
2005/0193983 A1* 9/2005 Ohtani ..... 123/431
2006/0096572 A1* 5/2006 Satou et al. ..... 123/295

FOREIGN PATENT DOCUMENTS

| | | |
|---|---|---|
| DE | 198 53 799 A1 | 5/2000 |
| DE | 100 43 384 A1 | 3/2002 |
| JP | A 63-255539 | 10/1988 |
| JP | A 01-318725 | 12/1989 |
| JP | A 07-103051 | 4/1995 |
| JP | A 08-193535 | 7/1996 |
| JP | A 2001-020837 | 1/2001 |

* cited by examiner

*Primary Examiner*—Mahmoud Gimie
(74) *Attorney, Agent, or Firm*—Oliff & Berridge, PLC

(57) ABSTRACT

An internal combustion engine includes a port injector injecting a fuel into an intake port, an in-cylinder injector directly injecting a fuel into a combustion chamber, and an ECU. When the ECU determines that an operation state of the internal combustion engine exhibits a transition state, the ECU obtains an estimated load factor of the internal combustion engine based on the operation state of the internal combustion engine, and calculates a fuel injection ratio between the port injector and the in-cylinder injector based on the estimated load factor.

10 Claims, 4 Drawing Sheets

DEVICE AND METHOD FOR CONTROLLING INTERNAL COMBUSTION ENGINE

This nonprovisional application is based on Japanese Patent Application No. 2004-226035 filed with the Japan Patent Office on Aug. 2, 2004, the entire contents of which are hereby incorporated by reference.

BACKGROUND OF THE INVENTION

1. Field of the Invention

The present invention relates to a device and a method for controlling an internal combustion engine including a port injector injecting a fuel into an intake port and an in-cylinder injector directly injecting a fuel into a combustion chamber.

2. Description of the Background Art

An internal combustion engine including a port injector injecting a fuel into an intake port and an in-cylinder injector directly injecting a fuel into a combustion chamber has conventionally been known (see, for example, Japanese Patent Laying-Open No. 63-255539). In the internal combustion engine, fuel injection is switched between the in-cylinder injector and the port injector, depending on a load. In addition, when switching from the in-cylinder injector to the port injector should be made at the time of acceleration of the internal combustion engine, switching between the injectors is delayed, in order to suppress leaner air-fuel ratio or increase in NOx due to switching between the injectors at the time of acceleration.

When switching between the port injector and the in-cylinder injector is made or a fuel injection ratio between the port injector and the in-cylinder injector is considerably fluctuated, a combustion state in the combustion chamber of the internal combustion engine is also significantly varied. Accordingly, even if switching from the in-cylinder injector to the port injector is delayed as in the conventional internal combustion engine described above, satisfactory suppression of torque fluctuation of the internal combustion engine or deviation from a target air-fuel ratio in a transition state such as acceleration has been difficult to achieve.

SUMMARY OF THE INVENTION

From the foregoing, an object of the present invention is to provide a device and a method for controlling an internal combustion engine, capable of satisfactorily suppressing torque fluctuation of the internal combustion engine or deviation from a target air-fuel ratio when switching between a port injector and an in-cylinder injector is made or a fuel injection ratio between the port injector and the in-cylinder injector is considerably fluctuated.

According to the present invention, a control device of an internal combustion engine having a port injector injecting a fuel into an intake port and an in-cylinder injector directly injecting a fuel into a combustion chamber and generating power by burning an air-fuel mixture in the combustion chamber includes: a determination unit determining whether or not an operation state of the internal combustion engine exhibits a transition state; a load estimation unit estimating a load factor of the internal combustion engine based on the operation state of the internal combustion engine when the determination unit determines that the operation state of the internal combustion engine exhibits the transition state; and an injection ratio calculation unit calculating a fuel injection ratio between the port injector and the in-cylinder injector based on the load factor estimated by the load estimation unit.

The present control device of the internal combustion engine is applied to the internal combustion engine having the port injector and the in-cylinder injector, and includes the determination unit, the load estimation unit, and the injection ratio calculation unit. The determination unit determines whether or not an operation state of the internal combustion engine exhibits a transition state, and the load estimation unit estimates a load factor of the internal combustion engine based on a parameter indicating the operation state of the internal combustion engine such as engine speed or throttle opening position when the determination unit determines that the operation state of the internal combustion engine exhibits the transition state. The injection ratio calculation unit calculates a fuel injection ratio between the port injector and the in-cylinder injector based on the load factor estimated by the load estimation unit.

In the internal combustion engine including the control device described above, when the internal combustion engine enters the transition state such as acceleration, the load estimation unit estimates a load factor, and a fuel injection ratio between the port injector and the in-cylinder injector is calculated based on an estimated value of the load factor (an estimated load factor). Therefore, when the fuel injection ratio between the port injector and the in-cylinder injector is changed in the transition state (including switching between the port injector and the in-cylinder injector), one or both of the port injector and the in-cylinder injector quickly injects the fuel in an appropriate quantity in accordance with the fuel injection ratio calculated based on the estimated load factor. As such, the control device can satisfactorily suppress torque fluctuation of the internal combustion engine or deviation from a target air-fuel ratio when the fuel injection ratio is changed (switching between the injectors is made) in the transition state.

Preferably, the control device of an internal combustion engine according to the present invention further includes an injection ratio setting unit permitting change in the fuel injection ratio between the port injector and the in-cylinder injector when an amount of fluctuation from a previous value of the fuel injection ratio calculated by the injection ratio calculation unit is larger than a prescribed value.

With such a configuration, when an amount of fluctuation from a previous fuel injection ratio calculated by the injection ratio calculation unit is not larger than the prescribed value, no change in the fuel injection ratio between the port injector and the in-cylinder injector (switching between the port injector and the in-cylinder injector) is made. Accordingly, as the number of times of change in the fuel injection ratio (switching between the injectors) can be decreased, a probability of occurrence of torque fluctuation of the internal combustion engine or deviation from a target air-fuel ratio can be lowered.

Preferably, the internal combustion engine is applied to a vehicle including a cruise control system allowing automatic cruise drive, and the injection ratio setting unit prohibits change in the fuel injection ratio between the port injector and the in-cylinder injector when the determination unit has determined that the operation state of the internal combustion engine does not exhibit the transition state and while the cruise control system is actuated.

Generally, in a vehicle including a cruise control system for controlling a vehicle speed to a substantially constant value, acceleration and deceleration is executed in accordance with its running condition. Therefore, in some cases, the fuel injection ratio between the port injector and the in-cylinder injector should be changed (switching between the port injector and the in-cylinder injector should be made)

during actuation of the cruise control system. In a state where the vehicle speed is maintained substantially constant by the cruise control system, however, shock due to torque fluctuation of the internal combustion engine or deviation of an air-fuel ratio caused by change in the fuel injection ratio is likely to be felt by human body.

Accordingly, while the operation state of the internal combustion engine does not exhibit the transition state and the cruise control system is actuated, change in the fuel injection ratio between the port injector and the in-cylinder injector is preferably prohibited. By prohibiting change in the fuel injection ratio (switching between the injectors) during actuation of the cruise control system, frequency that the human body feels shock due to torque fluctuation or deviation of an air-fuel ratio caused by change in the fuel injection ratio can be lowered.

Another control device of an internal combustion engine according to the present invention having a port injector injecting a fuel into an intake port and an in-cylinder injector directly injecting a fuel into a combustion chamber, being combined with a transmission, and generating power by burning an air-fuel mixture in the combustion chamber includes: a determination unit determining whether or not a shift change request has been issued to the transmission; a load estimation unit estimating a load factor of the internal combustion engine based on an operation state of the internal combustion engine when the determination unit determines that the shift change request has been issued; and an injection ratio calculation unit calculating a fuel injection ratio between the port injector and the in-cylinder injector based on the load factor estimated by the load estimation unit. The fuel injection ratio between the port injector and the in-cylinder injector is changed at the time of shift change of the transmission.

This control device of the internal combustion engine is also applied to the internal combustion engine having the port injector and the in-cylinder injector, and includes the determination unit, the load estimation unit, and the injection ratio calculation unit. The determination unit determines whether or not a shift change request has been issued to the transmission. When the determination unit determines that the shift change request has been issued, the load estimation unit estimates a load factor of the internal combustion engine based on a parameter indicating the operation state of the internal combustion engine such as estimated engine speed after shift change or throttle opening position at that time point. The injection ratio calculation unit calculates a fuel injection ratio between the port injector and the in-cylinder injector based on the load factor estimated by the load estimation unit. The control device changes the fuel injection ratio between the port injector and the in-cylinder injector at the time of shift change of the transmission.

In the internal combustion engine including the control device, at the timing of shift change, the load estimation unit estimates a load factor of the internal combustion engine, and a fuel injection ratio between the port injector and the in-cylinder injector is calculated based on an estimated value of the load factor (estimated load factor). In addition, change in the fuel injection ratio (switching between the injectors) is made substantially simultaneous to the shift change, and one or both of the port injector and the in-cylinder injector quickly injects the fuel in an appropriate quantity in accordance with the fuel injection ratio calculated based on the estimated load factor. Therefore, the control device can satisfactorily suppress torque fluctuation of the internal combustion engine or deviation from a target air-fuel ratio when the fuel injection ratio is changed (switching between the injectors is made). In addition, even if slight torque fluctuation takes place due to change in the fuel injection ratio, it can be cancelled by shock at the time of shift change tolerable in terms of human perception.

A method of controlling an internal combustion engine having a port injector injecting a fuel into an intake port and an in-cylinder injector directly injecting a fuel into a combustion chamber and generating power by burning an air-fuel mixture in the combustion chamber according to the present invention includes the steps of:

(a) determining whether or not an operation state of the internal combustion engine exhibits a transition state;

(b) estimating a load factor of the internal combustion engine based on the operation state of the internal combustion engine when a determination unit determines that the operation state of the internal combustion engine exhibits the transition state; and (c) calculating a fuel injection ratio between the port injector and the in-cylinder injector based on the load factor estimated at step (b).

Another method of controlling an internal combustion engine having a port injector injecting a fuel into an intake port and an in-cylinder injector directly injecting a fuel into a combustion chamber, being combined with a transmission, and generating power by burning an air-fuel mixture in the combustion chamber according to the present invention includes the steps of:

(a) determining whether or not a shift change request has been issued to the transmission;

(b) estimating a load factor of the internal combustion engine based on an operation state of the internal combustion engine when it is determined at step (a) that the shift change request has been issued;

(c) calculating a fuel injection ratio between the port injector and the in-cylinder injector based on the load factor estimated at step (b); and (d) changing the fuel injection ratio between the port injector and the in-cylinder injector at the time of shift change of the transmission.

According to the present invention, a device and a method for controlling an internal combustion engine, capable of satisfactorily suppressing torque fluctuation of the internal combustion engine or deviation from a target air-fuel ratio when switching between a port injector and an in-cylinder injector is made or a fuel injection ratio between the port injector and the in-cylinder injector is considerably fluctuated, can be obtained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A best mode for carrying out the present invention will be described hereinafter with reference to the drawings.

Figure 1:
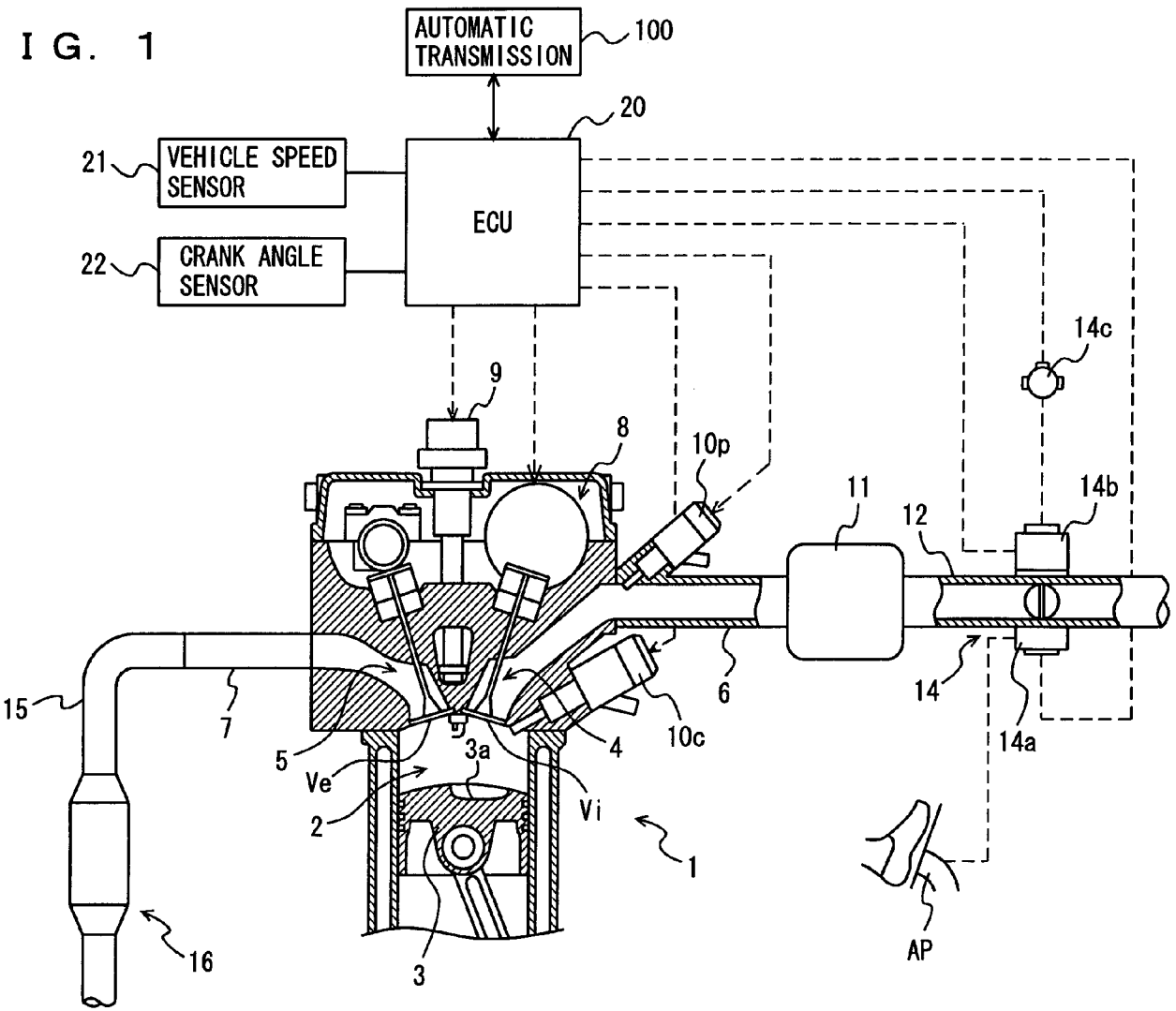
FIG. 1 is a schematic diagram of a configuration of an internal combustion engine to which a control device according to the present invention is applied.

FIG. 1 is a schematic diagram of a configuration of an internal combustion engine to which a control device according to the present invention is applied. An internal combustion engine 1 shown in FIG. 1 is implemented as a multi-cylinder internal combustion engine for a vehicle (for example, a 4-cylinder internal combustion engine, although FIG. 1 shows only one cylinder). Internal combustion engine 1 receives power from a not-shown crankshaft, as a result of reciprocating motion of a piston 3 caused by combustion of an air-fuel mixture in each combustion chamber 2. Though internal combustion engine 1 is herein described as what is called a gasoline engine, the present invention is not limited thereto and the present invention is naturally applicable also to a diesel engine.

As shown in FIG. 1, an intake port 4 communicating to each combustion chamber 2 is connected to an intake manifold 6, and an exhaust port 5 communicating to each combustion chamber 2 is connected to an exhaust manifold 7. An intake valve Vi opening and closing intake port 4 and an exhaust valve Ve opening and closing exhaust port 5 are disposed in a cylinder head of internal combustion engine 1, for each combustion chamber 2. Each intake valve Vi and each exhaust valve Ve are opened and closed by a valve-actuating mechanism 8, which includes a valve-timing varying mechanism (valve-opening property setting means) capable of varying a valve-opening property of at least one of intake valve Vi and exhaust valve Ve. In addition, internal combustion engine 1 includes spark plugs 9 of which number corresponds to the number of cylinders, and spark plug 9 is disposed in the cylinder head in a protruding manner in corresponding combustion chamber 2.

Moreover, internal combustion engine 1 includes in-cylinder injectors 10*c* of which number corresponds to the number of cylinders. Each in-cylinder injector 10*c* can directly inject a fuel such as gasoline into corresponding combustion chamber 2, and is connected to a fuel tank storing a liquid fuel such as gasoline through a fuel supply pipe (none of the above is shown). Furthermore, as shown in FIG. 1, internal combustion engine 1 includes a plurality of port injectors 10*p* of which number corresponds to the number of cylinders. Each port injector 10*p* can inject a fuel such as gasoline into corresponding intake port 4, and is connected to the fuel tank storing a liquid fuel such as gasoline through a not-shown fuel supply pipe. At least one in-cylinder injector 10*c* is provided for each combustion chamber 2, and at least one port injector 10*p* is provided for each intake port 4.

Each piston 3 of internal combustion engine 1 is formed to have what is called a deep-bowl in its top surface, that is, it has a concave portion 3*a* formed in the top surface. In internal combustion engine 1, the fuel such as gasoline can directly be injected from each in-cylinder injector 10*c* toward concave portion 3*a* of piston 3 in each combustion chamber 2 in such a state that air has been taken in each combustion chamber 2. As a layer of the air-fuel mixture is formed in the vicinity of spark plug 9 in a manner separated from a surrounding air layer (stratified), internal combustion engine 1 can use an extremely lean air-fuel mixture to perform stable stratified combustion.

Meanwhile, as shown in FIG. 1, intake manifold 6 is connected to a surge tank 11, which is connected to a not-shown air cleaner through an air supply pipe 12. In addition, a throttle valve 14 for adjusting an intake air quantity is provided in a midpoint of air supply pipe 12. In the present embodiment, an electronically controlled throttle valve including an accelerator position sensor 14*a* detecting an operated amount (pressed amount) of an accelerator pedal AP, a throttle motor 14*b* for opening and closing throttle valve 14, and a throttle opening position sensor 14*c* for detecting an opening position of throttle valve 14 is adopted as throttle valve 14. In addition, as shown in FIG. 1, exhaust manifold 7 is connected to an exhaust pipe 15. A catalytic device 16 containing, for example, an NOx occluding and reducing catalyst is provided in a midpoint of exhaust pipe 15, and catalytic device 16 purifies exhaust gas from each combustion chamber 2.

Internal combustion engine 1 described above includes an electronic control unit 20 (hereinafter, referred to as "ECU") implementing a control device according to the present invention. ECU 20 includes a CPU, an ROM, an RAM, an input/output port, a memory device storing a variety of types of information and a map, and the like, none of which is shown. ECU 20 has the input/output port connected to valve-actuating mechanism 8, spark plug 9, each injector 10*c*, 10*p*, accelerator position sensor 14*a*, throttle motor 14*b*, and throttle opening position sensor 14*c* described above, as well as a variety of sensors such as a vehicle speed sensor 21 and a crank angle sensor 22. A crankshaft (not shown) of internal combustion engine 1 is connected to an automatic transmission 100 with a damper or the like being interposed. Automatic transmission 100 supplies ECU 20 with a signal indicating information on a shift position, a transmission status, or the like.

ECU 20 uses a variety of maps stored in the memory device, and controls valve-actuating mechanism 8, spark plug 9, each injector 10*c* and 10*p*, throttle valve 14, and the like based on a value detected by the variety of sensors, so as to obtain a desired output. In addition, in the present embodiment, ECU 20 along with vehicle speed sensor 21 constitutes what is called a cruise control system (a constant-speed control system). In other words, ECU 20 controls throttle valve 14 and each injector 10*c*, 10*p* such that a running speed of a vehicle detected by vehicle speed sensor 21 is maintained at a prescribed value when a prescribed switch provided in the vehicle is turned on.

In internal combustion engine 1 including port injector 10*p* and in-cylinder injector 10*c*, from a viewpoint of improvement in performance and reduction in emission, the fuel injection ratio between port injector 10*p* and in-cylinder injector 10*c* is relatively frequently changed. Here, changing the fuel injection ratio encompasses switching between port injector 10*p* and in-cylinder injector 10*c*, which means that a fuel injection quantity from one of port injector 10*p* and in-cylinder injector 10*c* is set to zero.

Figure 2:
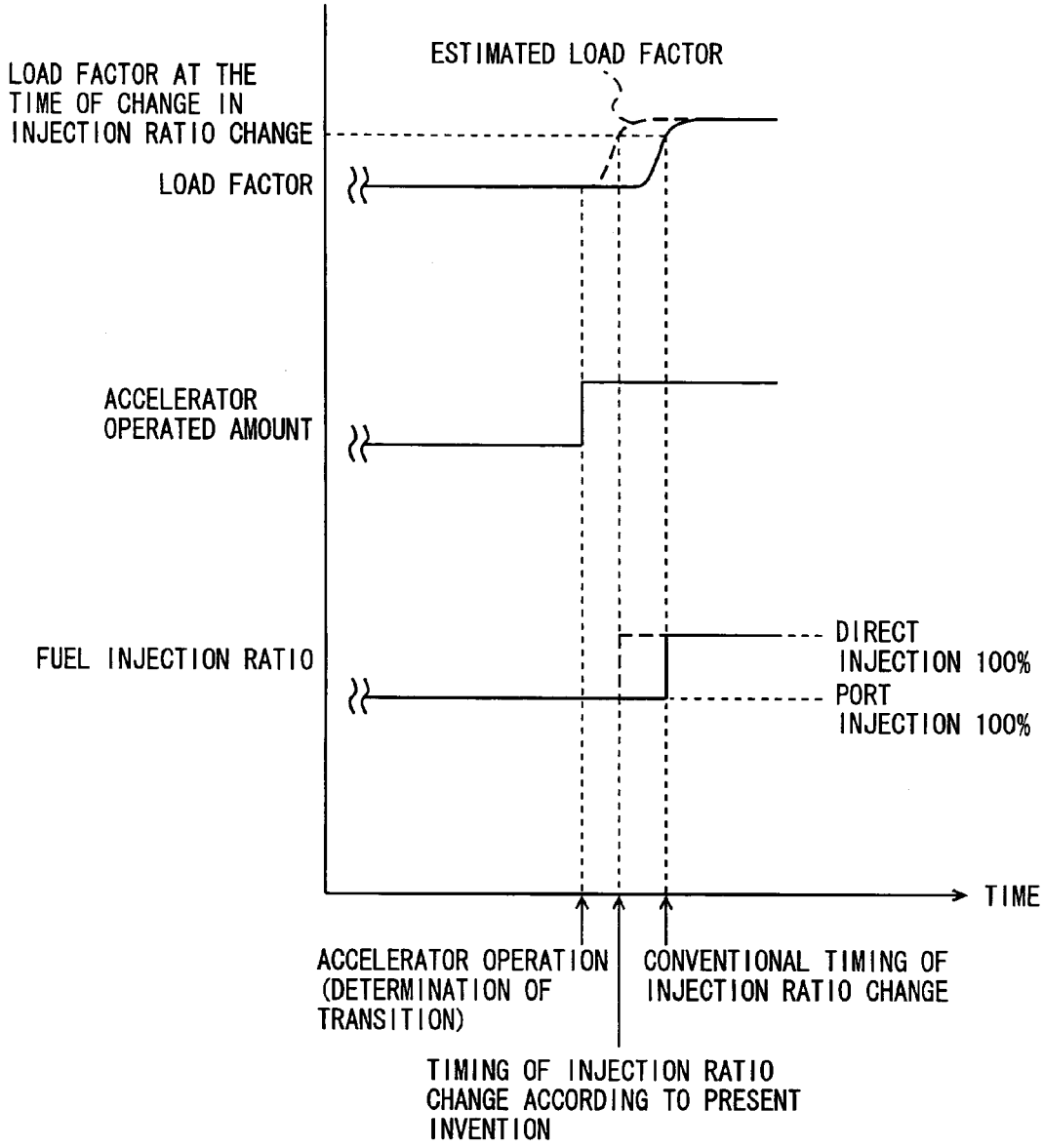
FIG. 2 is a time chart for illustrating an operation of the internal combustion engine in FIG. 1.

The fuel injection ratio between port injector 10*p* and in-cylinder injector 10*c* is set basically based on a load factor of internal combustion engine 1 determined by an intake air quantity. Here, when the load factor is suddenly varied in the transition state of internal combustion engine 1 such as acceleration or deceleration, in response, switching between port injector 10*p* and in-cylinder injector 10*c* or great change in the fuel injection ratio is made. If no measure is taken, however, a time lag between the operation of accelerator pedal AP by a driver of the vehicle and setting of the fuel injection ratio between port injector 10*p* and in-cylinder injector 10*c* may relatively be great, as shown in FIG. 2. This may cause torque fluctuation of internal combustion engine 1 or deviation from a target air-fuel ratio, which results in deterioration in drivability or emission.

Figure 3:
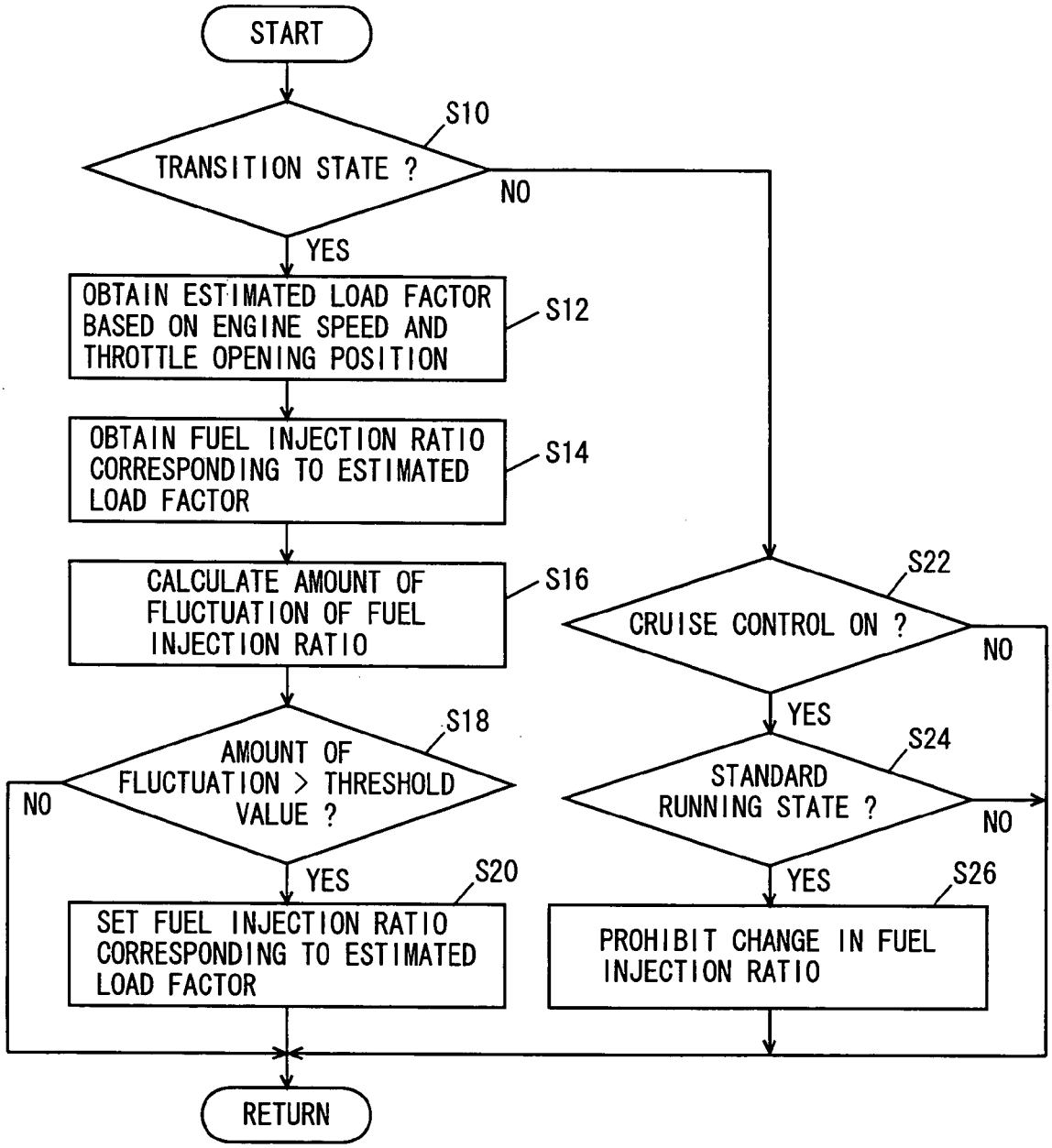
FIG. 3 is a flowchart illustrating a routine executed for changing a fuel injection ratio between a port injector and an in-cylinder injector in the internal combustion engine in FIG. 1.

Taking into account these factors, in internal combustion engine 1 according to the present embodiment, in order to suppress torque fluctuation or deviation of an air-fuel ratio due to change in the fuel injection ratio between port injector 10*p* and in-cylinder injector 10*c* to improve drivability and reduce emission, ECU 20 repeatedly executes a routine shown in FIG. 3 every prescribed time period. Here, ECU 20 derives a variation ΔTA per unit time, of opening position TA of throttle valve 14 (throttle opening position) based on a signal from throttle opening position sensor 14*c* during operation of internal combustion engine 1, and determines whether or not the operation state of internal combustion engine 1 exhibits the transition state, based on derived variation ΔTA (S10). At S10, when an absolute value of variation ΔTA of throttle opening position TA is larger than a prescribed value, ECU 20 determines that the operation state of internal combustion engine 1 exhibits the transition state.

At S10, if it is determined that the operation state of internal combustion engine 1 enters the transition state based on a fact that an amount of accelerator operation by the driver of the vehicle has considerably been changed, ECU 20 obtains at S12 an engine speed Ne at that time based on a signal from crank angle sensor 22, and obtains throttle opening position TA at that time based on a signal from throttle opening position sensor 14*c*. In addition, ECU 20 estimates (obtains) a load factor immediately after the accelerator operation by the driver (estimated load factor, see a dashed line in FIG. 2) based on obtained engine speed Ne and throttle opening position TA. In the present embodiment, a load factor estimation map defining correlation between engine speed Ne, throttle opening position TA and the load factor of internal combustion engine 1 (estimated load factor) is prepared in advance taking into account various experiment results, and the map is stored in the memory device of ECU 20. Then, at S12, ECU 20 reads from the load factor estimation map the estimated load factor corresponding to engine speed Ne and throttle opening position TA obtained at S12.

After obtaining the estimated load factor at S12, ECU 20 obtains the fuel injection ratio between port injector 10*p* and in-cylinder injector 10*c* corresponding to the estimated load factor (S14). In the present embodiment, an injection ratio setting map defining relation between the load factor of internal combustion engine 1 and the fuel injection ratio between port injector 10*p* and in-cylinder injector 10*c* is prepared in advance, and the map is stored in the memory device of ECU 20. Then, at S14, ECU 20 reads from the injection ratio setting map the fuel injection ratio corresponding to the estimated load factor obtained at S12.

Thereafter, ECU 20 reads a previous fuel injection ratio from a prescribed memory area and calculates a difference between the previous fuel injection ratio and the fuel injection ratio obtained at S14, so as to calculate an amount of fluctuation (absolute value) of the fuel injection ratio (S16). For example, the previous fuel injection ratio is assumed as: injection quantity from port injector 10*p*:injection quantity from in-cylinder injector 10*c*=100%:0%. Meanwhile, the fuel injection ratio obtained at S14 is assumed as: injection quantity from port injector 10*p*:injection quantity from in-cylinder injector 10*c*=0%:100%. Then, the amount of fluctuation of the fuel injection ratio calculated at S16 is "100". Basically, the larger the variation of the load factor is, the larger the amount of fluctuation of the fuel injection ratio representing a difference between the fuel injection ratio obtained at S14 and the previous fuel injection ratio is.

Thereafter, ECU 20 determines whether or not the amount of fluctuation of the fuel injection ratio is larger than a predetermined threshold value (for example, "30" at which shock due to fluctuation of torque as a result of change in the fuel injection ratio is felt) (S18). If it is determined at S18 that the amount of fluctuation of the fuel injection ratio is larger than the threshold value, ECU 20 supplies a prescribed control signal to port injector 10*p* and in-cylinder injector 10*c* so as to set the fuel injection ratio between port injector 10*p* and in-cylinder injector 10*c* to the value obtained at S14 (the fuel injection ratio corresponding to the estimated load factor).

In this manner, when the fuel injection ratio between the port injector 10*p* and in-cylinder injector 10*c* is changed in the transition state (switching between the port injector and the in-cylinder injector is made in the example of FIG. 2), as shown with the dashed line in FIG. 2, one or both of port injector 10*p* and in-cylinder injector 10*c* (in-cylinder injector 10*c* in the example of FIG. 2) quickly injects the fuel in an appropriate quantity in accordance with the fuel injection ratio calculated based on the estimated load factor In other words, it is when the operation state of internal combustion engine 1 exhibits the transition state and the amount of fluctuation of fuel injection ratio, i.e., the variation of the load factor, is relatively large that processing for changing the fuel injection ratio (S20) is permitted at S18. In such a case, basically, the estimated load factor derived by ECU 20 is larger than a load factor at the time of change in the injection ratio change, that is, when the processing for changing the fuel injection ratio in accordance with the load factor of internal combustion engine 1 is performed. Therefore, in internal combustion engine 1, as shown with the dashed line in FIG. 2, the time lag between the operation of accelerator pedal AP by the driver of the vehicle and the change in the fuel injection ratio between port injector 10*p* and in-cylinder injector 10*c* can be decreased as compared with an conventional example. Consequently, in internal combustion engine 1, torque fluctuation of internal combustion engine 1 or deviation from a target air-fuel ratio when the fuel injection ratio is changed (switching between the injectors is made) in the transition state can satisfactorily be suppressed, thereby maintaining excellent drivability and reducing emission.

Meanwhile, if it is determined at S18 that the amount of fluctuation of the fuel injection ratio is not larger than the threshold value, the processing at S20 is skipped, and the processing for changing the fuel injection ratio between port injector 10*p* and in-cylinder injector 10*c* (processing for switching between the injectors) is not performed. Therefore, as unnecessary increase in the number of times of change in the fuel injection ratio (switching between the injectors) can be suppressed, a probability of occurrence of torque fluctuation of internal combustion engine 1 or deviation from a target air-fuel ratio can be lowered.

ECU 20 of internal combustion engine 1 according to the present embodiment, along with vehicle speed sensor 21, constitutes what is called a cruise control system. Therefore, when a prescribed switch is turned on by the driver of the vehicle, ECU 20 controls the vehicle speed to a substantially constant value regardless of intention of the driver, and acceleration and deceleration is carried out in accordance with a running condition of the vehicle. In some cases, the fuel injection ratio between port injector 10*p* and in-cylinder injector 10*c* should be changed (switching between the injectors should be made) while the cruise control by ECU 20 is exerted (while the cruise control system is turned on). In a state where ECU 20 maintains the vehicle speed substantially constant, however, shock due to torque fluctuation of internal combustion engine 1 or deviation of an air-fuel ratio caused by the change in the fuel injection ratio is likely to be felt by human body.

In view of these factors, if it is determined at S10 that the operation state of the internal combustion engine does not exhibit the transition state, ECU 20 determines whether or not cruise control by ECU 20 is exerted (whether cruise control system is turned on or not) (S22). In addition, if it is determined at S22 that cruise control by ECU 20 is turned on, ECU 20 determines whether or not the vehicle is in a standard running state (whether or not it is under uphill or downhill control), based on a signal from vehicle speed sensor 21 (vehicle speed), a signal from throttle opening position sensor 14*c* (load factor), or the like (S24).

If it is determined that cruise control by ECU 20 is exerted and the vehicle is in the standard running state (S24), ECU 20 prohibits change in the fuel injection ratio between port injector 10*p* and in-cylinder injector 10*c* (S26). In this manner, in internal combustion engine 1, while cruise control by ECU 20 is exerted (while cruise control system is turned on), change in the fuel injection ratio (switching between the injectors) is basically prohibited so that frequency that the human body feels shock due to torque fluctuation or deviation of an air-fuel ratio as a result of change in the fuel injection ratio can be lowered. If it is determined as NO at S22 or S24, the processing at S26 is not performed, and the processing at S10 or later is repeated again.

Figure 4:
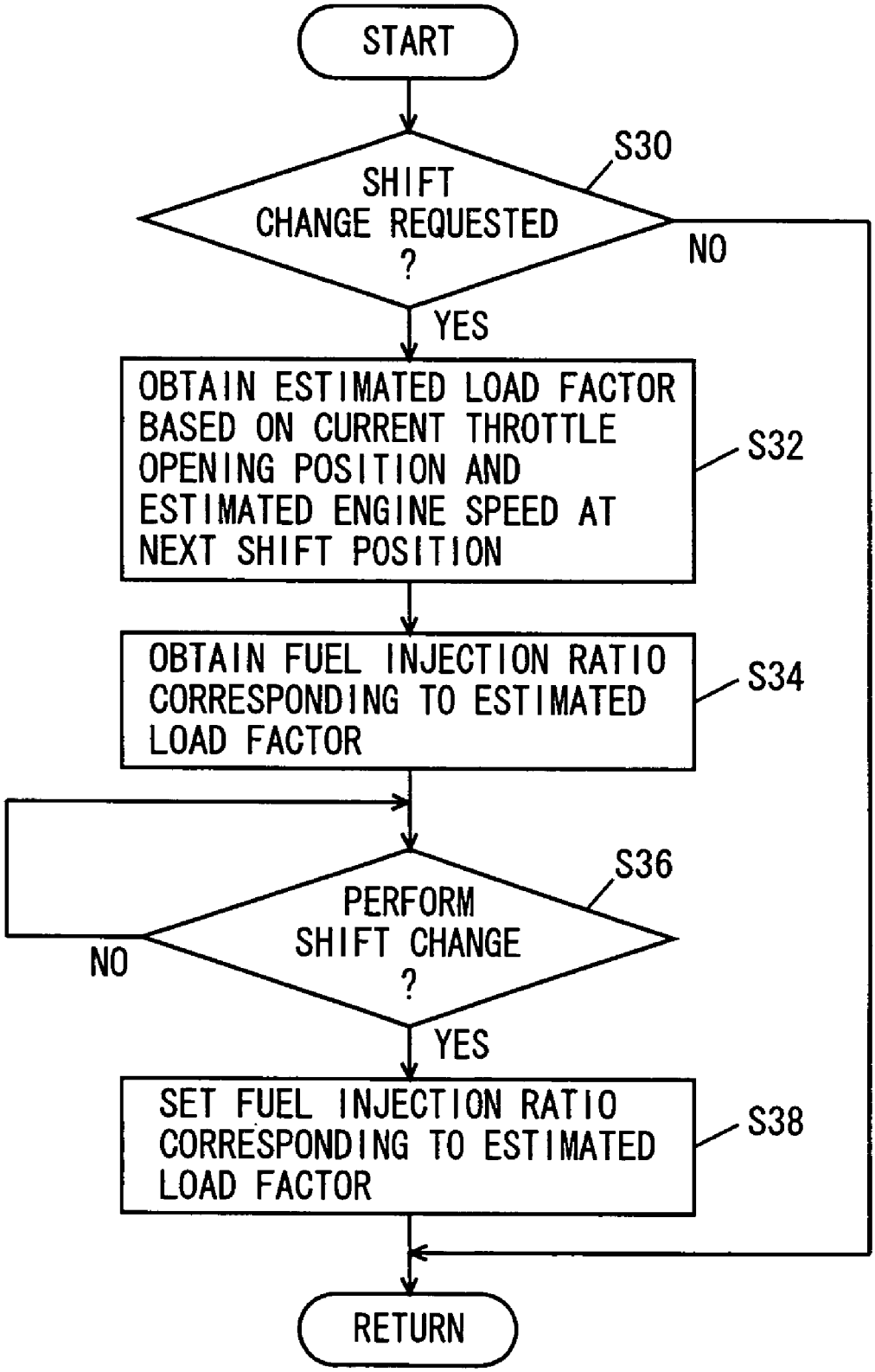
FIG. 4 is a flowchart illustrating another routine executed for changing a fuel injection ratio between a port injector and an in-cylinder injector in the internal combustion engine in FIG. 1.

FIG. 4 is a flowchart illustrating another routine executed for changing a fuel injection ratio between port injector 10*p* and in-cylinder injector 10*c* in internal combustion engine 1 described above. The routine in FIG. 4 is repeatedly executed by ECU 20 concurrently with the routine shown in FIG. 3 every prescribed time period. When the routine in FIG. 4 is executed, ECU 20 initially determines whether or not a shift change request has been issued to automatic transmission 100, based on a signal from vehicle speed sensor 21 (vehicle speed), a signal from throttle opening sensor 14*c* (load factor), or the like (S30).

If it is determined at S30 that a shift change request has been issued to automatic transmission 100, ECU 20 obtains throttle opening position TA at that time based on a signal from throttle opening position sensor 14*c*, and obtains an estimated engine speed Ne' at a next shift position of automatic transmission 100 corresponding to the operation state at that time, using a predetermined function expression or the like. In addition, ECU 20 estimates (obtains) a load factor immediately after the shift change (estimated load factor) based on obtained throttle opening position TA and estimated engine speed Ne' (S32). In the present embodiment, a map defining correlation between throttle opening position TA, estimated engine speed Ne' and the load factor of internal combustion engine 1 is prepared in advance taking into account various experiment results, and the map is stored in the memory device of ECU 20. Then, at S32, ECU 20 reads from the map the estimated load factor corresponding to throttle opening position TA and estimated engine speed Ne' obtained at S32.

After obtaining the estimated load factor at S32, ECU 20 obtains the fuel injection ratio between port injector 10*p* and in-cylinder injector 10*c* corresponding to the estimated load factor (S34). Then, at S34, ECU 20 reads from the injection ratio setting map described above the fuel injection ratio corresponding to the estimated load factor obtained at S32. Thereafter, ECU 20 determines whether or not shift change of automatic transmission 100 is started (S36). When shift change of automatic transmission 100 is started, ECU 20 supplies a prescribed control signal to port injector 10*p* and in-cylinder injector 10*c* so as to set the fuel injection ratio between port injector 10*p* and in-cylinder injector 10*c* to the value obtained at S34 (the fuel injection ratio corresponding to the estimated load factor) (S38).

In this manner, in internal combustion engine 1, when the timing for shift change of automatic transmission 100 comes, the load factor after the shift change is estimated (S32), and the fuel injection ratio between port injector 10*p* and in-cylinder injector 10*c* is calculated based on the estimated value of the load factor (estimated load factor) (S34). Change in the fuel injection ratio (switching between the injectors) is made substantially simultaneous to the shift change (S38).

In this case as well, one or both of port injector 10*p* and in-cylinder injector 10*c* quickly injects the fuel in an appropriate quantity in accordance with the fuel injection ratio calculated based on the estimated load factor. Therefore, torque fluctuation of internal combustion engine 1 or deviation from a target air-fuel ratio when the fuel injection ratio is changed (switching between the injectors is made) can satisfactorily be suppressed. In addition, even if slight torque fluctuation takes place due to change in the fuel injection ratio, it can be cancelled by shock at the time of shift change tolerable in terms of human perception. If it is determined at S30 that the shift change request has not been issued to automatic transmission 100, the processing from S32 to S38 is skipped, and ECU 20 executes the routine in FIG. 4 again at next execution timing.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of an internal combustion engine having a port injector injecting a fuel into an intake port and an in-cylinder injector directly injecting a fuel into a combustion chamber and generating power by burning an air-fuel mixture in said combustion chamber, comprising:

determination means for determining whether an operation state of said internal combustion engine exhibits a transition state;

load estimation means for estimating a load factor of said internal combustion engine based on the operation state of said internal combustion engine when said determination means determines that the operation state of said internal combustion engine exhibits the transition state; and injection ratio calculation means for calculating a fuel injection ratio between said port injector and said in-cylinder injector based on said load factor estimated by said load estimation means.

2. The control device of an internal combustion engine according to claim 1, further comprising injection ratio setting means for permitting change in the fuel injection ratio between said port injector and said in-cylinder injector when an amount of fluctuation from a previous value of said fuel injection ratio calculated by said injection ratio calculation means is larger than a prescribed value.

3. The control device of an internal combustion engine according to claim 1, wherein said internal combustion engine is applied to a vehicle including a cruise control system allowing automatic cruise drive, and when said determination means has determined that the operation state of said internal combustion engine exhibits a state other than the transition state and while said cruise control system is actuated, said injection ratio setting means prohibits change in the fuel injection ratio between said port injector and said in-cylinder injector.

4. A control device of an internal combustion engine having a port injector injecting a fuel into an intake port and an in-cylinder injector directly injecting a fuel into a combustion chamber, being combined with a transmission, and generating power by burning an air-fuel mixture in said combustion chamber, comprising:

determination means for determining whether a shift change request has been issued to said transmission;

load estimation means for estimating a load factor of said internal combustion engine based on an operation state of said internal combustion engine when said determination means determines that the shift change request has been issued;

injection ratio calculation means for calculating a fuel injection ratio between said port injector and said in-cylinder injector based on said load factor estimated by said load estimation means; and means for changing the fuel injection ratio between said port injector and said in-cylinder injector when shift change of said transmission is performed.

5. A method of controlling an internal combustion engine having a port injector injecting a fuel into an intake port and an in-cylinder injector directly injecting a fuel into a combustion chamber and generating power by burning an air-fuel mixture in said combustion chamber, comprising the steps of:

(a) determining whether an operation state of said internal combustion engine exhibits a transition state;

(b) estimating a load factor of said internal combustion engine based on the operation state of said internal combustion engine when determination means determines that the operation state of said internal combustion engine exhibits the transition state; and (c) calculating a fuel injection ratio between said port injector and said in-cylinder injector based on said load factor estimated at said step (b).

6. A method of controlling an internal combustion engine having a port injector injecting a fuel into an intake port and an in-cylinder injector directly injecting a fuel into a combustion chamber, being combined with a transmission, and generating power by burning an air-fuel mixture in said combustion chamber, comprising the steps of:

(a) determining whether a shift change request has been issued to said transmission;

(b) estimating a load factor of said internal combustion engine based on an operation state of said internal combustion engine when it is determined at said step (a) that the shift change request has been issued;

(c) calculating a fuel injection ratio between said port injector and said in-cylinder injector based on said load factor estimated at said step (b); and (d) changing the fuel injection ratio between said port injector and said in-cylinder injector when shift change of said transmission is performed.

7. A control device of an internal combustion engine having a port injector injecting a fuel into an intake port and an in-cylinder injector directly injecting a fuel into a combustion chamber and generating power by burning an air-fuel mixture in said combustion chamber, comprising:

a determination unit determining whether an operation state of said internal combustion engine exhibits a transition state;

a load estimation unit estimating a load factor of said internal combustion engine based on the operation state of said internal combustion engine when said determination unit determines that the operation state of said internal combustion engine exhibits the transition state; and an injection ratio calculation unit calculating a fuel injection ratio between said port injector and said in-cylinder injector based on said load factor estimated by said load estimation unit.

8. The control device of an internal combustion engine according to claim 7, further comprising an injection ratio setting unit permitting change in the fuel injection ratio between said port injector and said in-cylinder injector when an amount of fluctuation from a previous value of said fuel injection ratio calculated by said injection ratio calculation unit is larger than a prescribed value.

9. The control device of an internal combustion engine according to claim 7, wherein said internal combustion engine is applied to a vehicle including a cruise control system allowing automatic cruise drive, and when said determination unit has determined that the operation state of said internal combustion engine exhibits a state other than the transition state and while said cruise control system is actuated, said injection ratio setting unit prohibits change in the fuel injection ratio between said port injector and said in-cylinder injector.

10. A control device of an internal combustion engine having a port injector injecting a fuel into an intake port and an in-cylinder injector directly injecting a fuel into a combustion chamber, being combined with a transmission, and generating power by burning an air-fuel mixture in said combustion chamber, comprising:

a determination unit determining whether a shift change request has been issued to said transmission;

a load estimation unit estimating a load factor of said internal combustion engine based on the operation state of said internal combustion engine when said determination unit determines that the shift change request has been issued; and an injection ratio calculation unit calculating a fuel injection ratio between said port injector and said in-cylinder injector based on said load factor estimated by said load estimation unit; wherein said fuel injection ratio between said port injector and said in-cylinder injector is changed when shift change of said transmission is performed.

* * * * *